US007194830B2

(12) United States Patent
Hess

(10) Patent No.: US 7,194,830 B2
(45) **Date of Patent: *Mar. 27, 2007**

(54) FLAME SIMULATING ASSEMBLY

(75) Inventor: Kristoffer Hess, Cambridge (CA)

(73) Assignee: Dimplex North America Limited, Cambridge (CA)

( * ) Notice: Subject to any disclaimer, the term of this patent is extended or adjusted under 35 U.S.C. 154(b) by 237 days.

This patent is subject to a terminal disclaimer.

(21) Appl. No.: 11/013,320

(22) Filed: Dec. 17, 2004

(65) Prior Publication Data

US 2005/0097793 A1 May 12, 2005

Related U.S. Application Data

(63) Continuation-in-part of application No. 10/312,008, filed as application No. PCT/CA01/01240 on Aug. 29, 2001, now abandoned, and a continuation-in-part of application No. 09/837,434, filed on Apr. 19, 2001, now Pat. No. 6,615,519, which is a continuation-in-part of application No. 09/649,043, filed on Aug. 29, 2000, now Pat. No. 6,564,485, which is a continuation-in-part of application No. 09/649,043, filed on Aug. 29, 2000, now Pat. No. 6,564,485.

(51) Int. Cl.
*G09F 19/00* (2006.01)

(52) U.S. Cl. ..... 40/428; 392/348

(58) Field of Classification Search ..... 40/428; 362/92, 96, 253, 806; 392/348; 472/65
See application file for complete search history.

(56) References Cited

U.S. PATENT DOCUMENTS

| | | | | |
|---|---|---|---|---|
| 1,199,882 | A | 10/1916 | Frey | 359/839 |
| 1,586,597 | A | 6/1926 | Berry | |
| 1,590,083 | A | 6/1926 | Collins | 40/428 |
| 1,604,850 | A | 10/1926 | Payne | 40/428 |
| 1,703,761 | A | 2/1929 | Berry | 40/428 |
| 1,719,622 | A | 7/1929 | Price | 40/428 |
| 1,901,294 | A | 3/1933 | Gritt et al. | 40/428 |
| 1,992,540 | A | 2/1935 | Newton | 40/428 |

(Continued)

FOREIGN PATENT DOCUMENTS

| | | |
|---|---|---|
| EP | 0 348 137 | 12/1989 |

(Continued)

OTHER PUBLICATIONS

International Search Report, dated Apr. 2, 2002, PCT/CA01/01240.

*Primary Examiner*—Robert J. Sandy
*Assistant Examiner*—Ruth C. Rodriguez

(57) ABSTRACT

A flame simulating assembly for providing an image of flames. The flame simulating assembly has a simulated fuel bed, a light source, and a screen with a front surface disposed behind the simulated fuel bed for transmitting light from the light source through the front surface so that the image of flames is transmitted through the front surface. Also, the flame simulating assembly includes a dynamic reflector disposed in front of the simulated fuel bed and including a plurality of reflective surfaces and an axis about which the reflective surfaces rotate. The dynamic reflector is positioned in a path of light from the light source to the simulated fuel bed, for reflecting light from the light source to the simulated fuel bed.

19 Claims, 16 Drawing Sheets

U.S. PATENT DOCUMENTS

| | | | | |
|---|---|---|---|---|
| 2,009,167 | A | 7/1935 | Delano | 359/596 |
| 2,285,535 | A | 6/1942 | Schlett | 40/428 |
| 2,984,032 | A | 5/1961 | Cornell | 40/428 |
| 3,395,476 | A | 8/1968 | Moss et al. | 40/428 |
| 3,499,239 | A | 3/1970 | Mungo | 40/428 |
| 3,526,984 | A | 9/1970 | Nielsen et al. | 40/428 |
| 3,603,013 | A | 9/1971 | Reed et al. | 56/13.5 |
| 3,699,697 | A | 10/1972 | Painton | 40/428 |
| 3,978,598 | A | 9/1976 | Rose et al. | 40/428 |
| 4,890,600 | A | 1/1990 | Meyers | 126/512 |
| 4,965,707 | A | 10/1990 | Butterfield | 362/96 |
| 5,642,580 | A | 7/1997 | Hess et al. | 40/428 |
| 6,047,489 | A | 4/2000 | Hess et al. | 40/428 |
| 6,162,047 | A | 12/2000 | Hess | 431/125 |
| 6,302,555 | B1 | 10/2001 | Bristow | 362/96 |
| 6,363,636 | B1 | 4/2002 | Hess et al. | 40/428 |
| 6,385,881 | B1 | 5/2002 | Hess | 40/428 |
| 6,393,207 | B1 | 5/2002 | Martin et al. | 392/348 |
| 6,454,425 | B1 | 9/2002 | Lin | 362/96 |
| 6,564,485 | B1 | 5/2003 | Hess | 40/428 |
| 6,615,519 | B2 | 9/2003 | Hess | 40/428 |
| 2002/0168182 | A1 | 11/2002 | Martin et al. | |
| 2002/0170215 | A1 | 11/2002 | Mix et al. | |
| 2002/0174579 | A1 | 11/2002 | Corry et al. | |
| 2003/0046837 | A1 | 3/2003 | Hess | |
| 2003/0126775 | A1 | 7/2003 | Corry et al. | |
| 2005/0252051 | A1 | 11/2005 | Chen | 40/428 |

FOREIGN PATENT DOCUMENTS

| | | |
|---|---|---|
| GB | 272362 | 6/1927 |
| GB | 272836 | 6/1927 |
| GB | 322688 | 12/1929 |
| GB | 414280 | 8/1934 |
| GB | 968568 | 9/1964 |
| GB | 978364 | 12/1964 |
| GB | 1088577 | 10/1967 |
| GB | 1 097 812 | 1/1968 |
| GB | 1186655 | 4/1970 |
| GB | 1443772 | 7/1976 |
| GB | 1457540 | 12/1976 |
| GB | 2149090 | 6/1985 |
| GB | 2151772 | 7/1985 |
| GB | 2180927 | 11/1988 |
| GB | 2240171 | 7/1991 |
| GB | 2242737 | 10/1991 |
| GB | 2256040 | 11/1992 |
| GB | 2 261 723 | 5/1993 |
| GB | 2264555 | 9/1993 |
| GB | 2 267 563 | 12/1993 |
| GB | 2 276 444 | 9/1994 |
| GB | 2288052 | 10/1995 |
| GB | 2 290 374 | 12/1995 |
| GB | 2290865 | 1/1996 |
| GB | 2298073 | 8/1996 |
| GB | 2 302 730 | 1/1997 |
| GB | 2325733 | 12/1998 |
| GB | 0611921 | 9/1999 |
| GB | 1020685 | 7/2000 |
| GB | 2 372 807 | 9/2002 |
| GB | 2 379 009 | 2/2003 |
| GB | 2 387 901 | 10/2003 |
| GB | 2 409 323 | 6/2005 |
| WO | PCT/CA97/00299 | 11/1997 |
| WO | PCT/CA99/00190 | 9/1999 |
| WO | WO 01/57447 | 8/2001 |
| WO | WO 2004/027321 | 4/2004 |
| WO | WO 2004/109189 | 12/2004 |
| WO | WO 2005/028962 | 3/2005 |

FLAME SIMULATING ASSEMBLY

This application is a continuation of application Ser. No. 10/312,008, filed on Dec. 23, 2002 now abandoned, which is the national stage of PCT/CA01/01240, filed on Aug. 29, 2001, which is a continuation-in-part of application Ser. No. 09/649,043 filed on Aug. 29, 2000, now U.S. Pat. No. 6,564,485, and which is a continuation-in-part of application Ser. No. 09/837,434 filed on Apr. 19, 2001, now U.S. Pat. No. 6,615,519, which is a continuation-in-part of application Ser. No. 09/649,043 filed on Aug. 29, 2000, now U.S. Pat. No. 6,564,485.

FIELD OF THE INVENTION

The invention relates to flame simulating assemblies for use in electric or gas fireplaces and, in particular, to a flame simulating assembly having a simulated fuel bed and including a reflector positioned in front of the simulated fuel bed.

BACKGROUND OF THE INVENTION

In general, known flame simulating devices have been primarily directed to simulating flames arising from simulated burning fuel, positioned in a simulated fuel bed. Usually the simulated fuel bed includes a simulation of a burning ember bed forming part of the simulated burning fuel, or positioned below the simulated burning fuel. Typically, the simulated burning fuel and the simulated ember bed are intended to resemble burning logs or burning coal. Where, as is usually the case, the simulated fuel bed is positioned at the front of the flame simulating assembly, the realistic simulation of burning fuel can contribute significantly to the overall effect achieved by the flame simulating assembly.

Positioning a static reflector inside the simulated fuel bed is known. Such positioning of a static reflector is disclosed in U.K. Patent No. 414,280 (Davis et al.), U.K. Patent No. 1,186,655 (Reed et al.), U.S. Pat. No. 1,992,540 (Newton), U.S. Pat. No. 3,699,697 (Painton), U.S. Pat. No. 3,978,598 (Rose et al.), and U.S. Pat. No. 4,890,600 (Meyers). In each of these patents, however, a static reflector is positioned inside a structure which forms all or a portion of a simulated fuel bed.

Positioning a movable reflector inside a simulated ember bed is disclosed in PCT Application No. PCT/CA99/00190 (Hess and Purton), filed on Mar. 4, 1999. This application discloses apertures positioned in the simulated ember bed to allow light reflected by the movable reflector to be reflected onto the simulated burning fuel.

There is a continuing need for a flame simulating assembly that more realistically simulates burning logs or coal, and burning embers of burning logs or coal.

SUMMARY OF THE INVENTION

In a broad aspect of the present invention, there is provided a flame simulating assembly for providing an image of flames. The flame simulating assembly has a simulated fuel bed, a light source, and a screen with a front surface disposed behind the simulated fuel bed for transmitting light from the light source through the front surface so that the image of flames is transmitted through the front surface. In addition, the flame simulating assembly includes a dynamic reflector disposed in front of the simulated fuel bed with a plurality of reflective surfaces and an axis about which the reflective surfaces rotate. The dynamic reflector is positioned in a path of light from the light source to the simulated fuel bed, for reflecting light from the light source to the simulated fuel bed.

In another aspect, the flame simulating assembly additionally includes a simulated grate disposed in front of the dynamic reflector. The simulated grate has an inner side disposed opposite an outer side thereof, and the inner side is positioned adjacent to the dynamic reflector. Also, the inner side of the simulated grate has a static reflective surface for reflecting light from the light source onto the simulated fuel bed.

In another of its aspects, the flame simulating assembly additionally includes a flicker element positioned in a path of light from the light source to the screen, to produce an image of flickering flames transmittable through the front surface of the screen.

In yet another aspect, the simulated fuel bed includes a simulated ember bed and one or more simulated fuel elements disposed above the simulated ember bed. Also, the simulated ember bed includes a translucent portion positioned in the path of light between the light source and the dynamic reflector, so that light from the light source is transmittable through the translucent portion.

In yet another aspect, the simulated fuel bed includes a simulated ember bed and one or more simulated fuel elements disposed above the simulated ember bed. The simulated ember bed includes a plurality of apertures positioned in the path of light from the light source to the dynamic reflector, so that light from the light source is transmittable through the apertures.

In another of its aspects, the present invention provides a flame simulating assembly having a simulated fuel bed, a bottom wall element, and a light source. The simulated fuel bed includes a simulated ember bed and one or more simulated fuel elements positioned above the simulated ember bed. The simulated ember bed is positioned at least partially above the bottom wall element and seated directly on the bottom wall element. Also, the simulated ember bed and the bottom wall element at least partially define a compartment located substantially inside the simulated ember bed. The simulated ember bed includes a front portion positioned in a path of light from the light source and adapted to permit light to be transmitted therethrough. The flame simulating assembly also includes a front wall which includes an observation zone and is positioned in front of the simulated fuel bed. The observation zone permits observation of the simulated fuel bed. Finally, the flame simulating assembly includes a dynamic reflector positioned above the bottom wall element, outside the compartment, and between the simulated ember bed and the front wall. The dynamic reflector is positioned in the path of light from the light source for reflecting light from the light source onto the simulated fuel bed. In addition, the dynamic reflector includes an axis and a number of reflective surfaces which rotate about the axis, for causing light from the light source to flicker and to be reflected onto the simulated fuel bed.

BRIEF DESCRIPTION OF THE DRAWINGS

The invention will be better understood with reference to the drawings, in which.

DETAILED DESCRIPTION OF THE PREFERRED EMBODIMENT(S)

Figure 1:
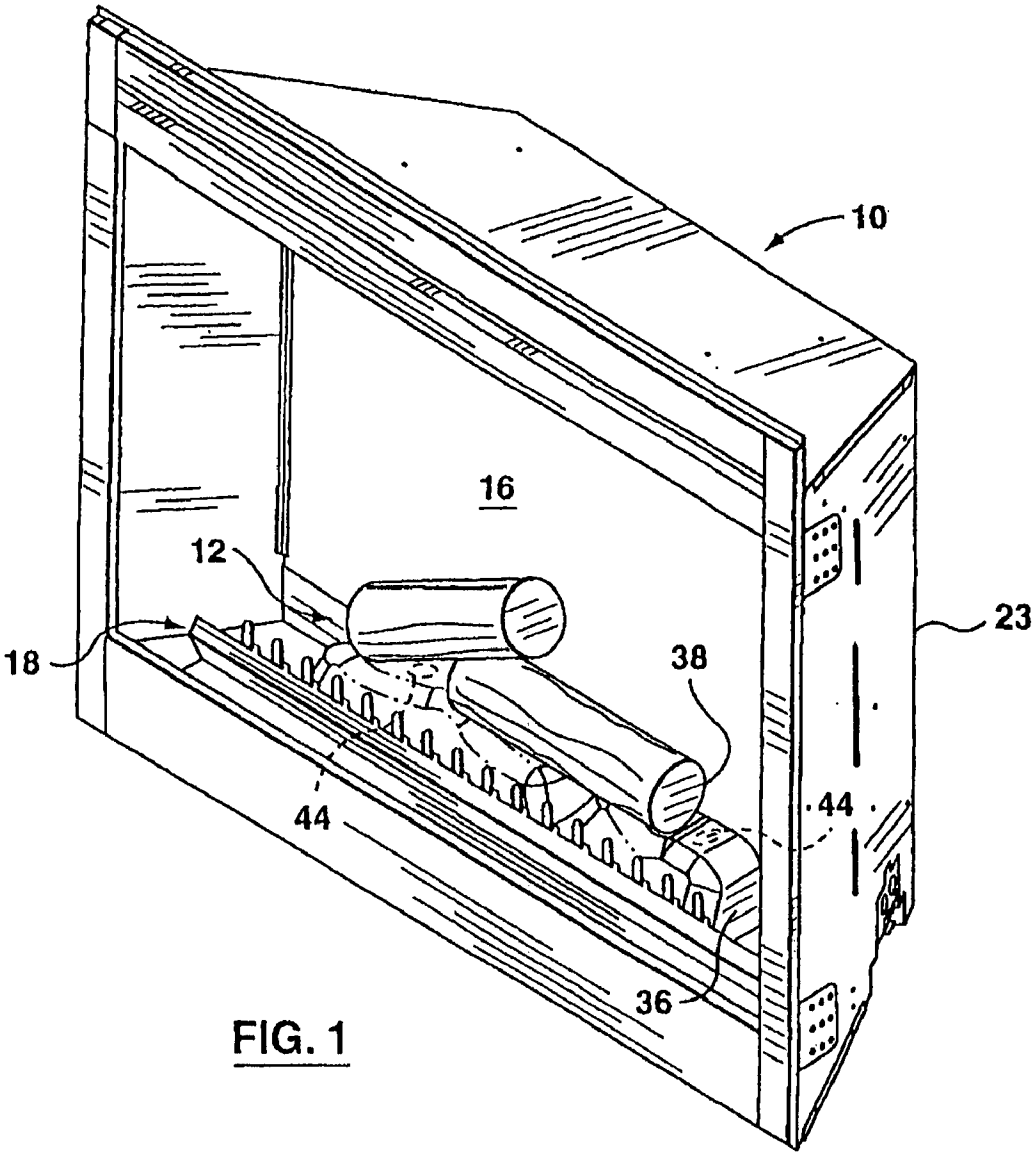
FIG. 1 is an isometric view of the front of the preferred embodiment of a flame simulating assembly of the invention, including a reflector and a screen.
Figure 2:
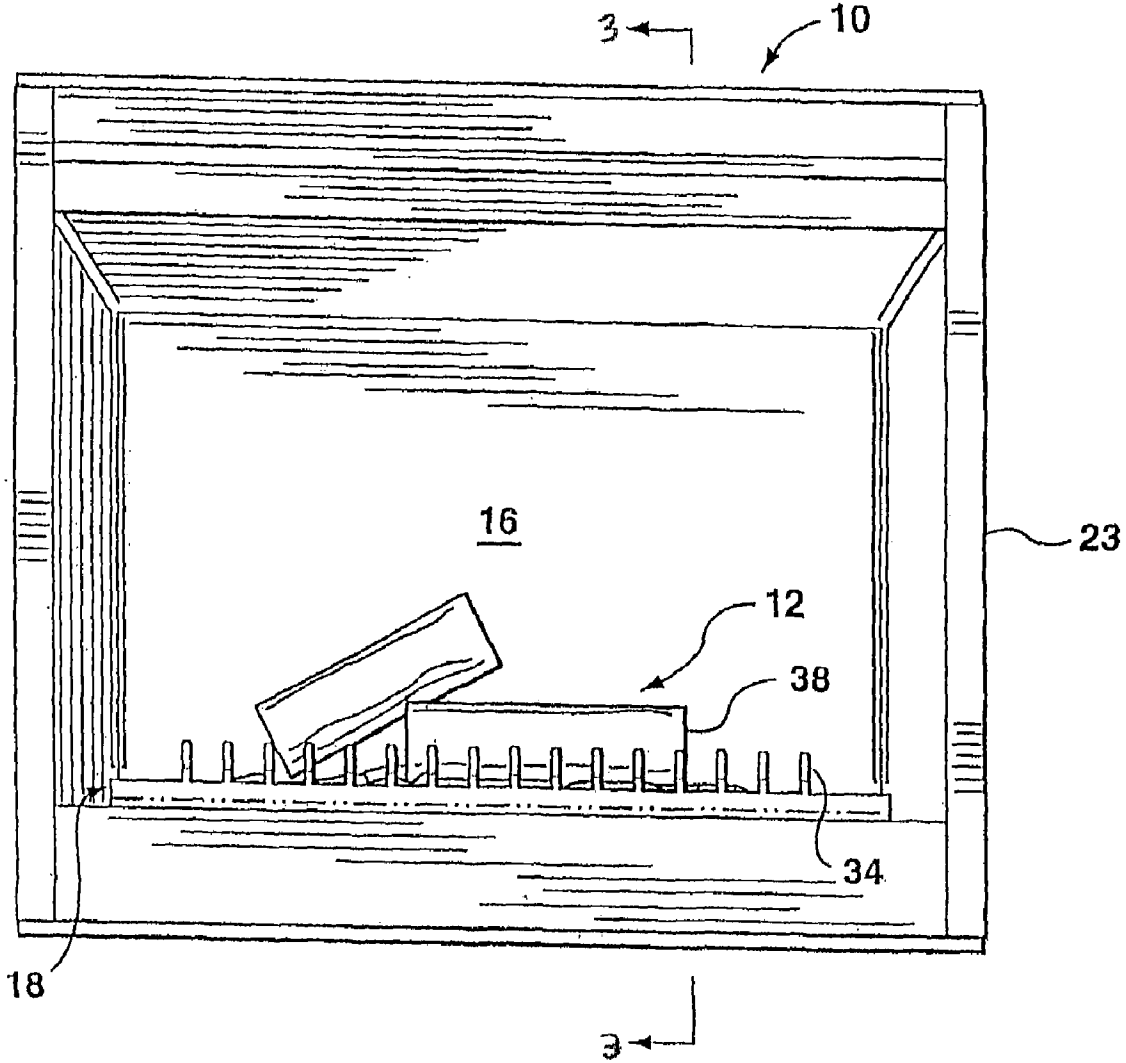
FIG. 2 is a front view of the flame simulating assembly of FIG. 1.
Figure 3:
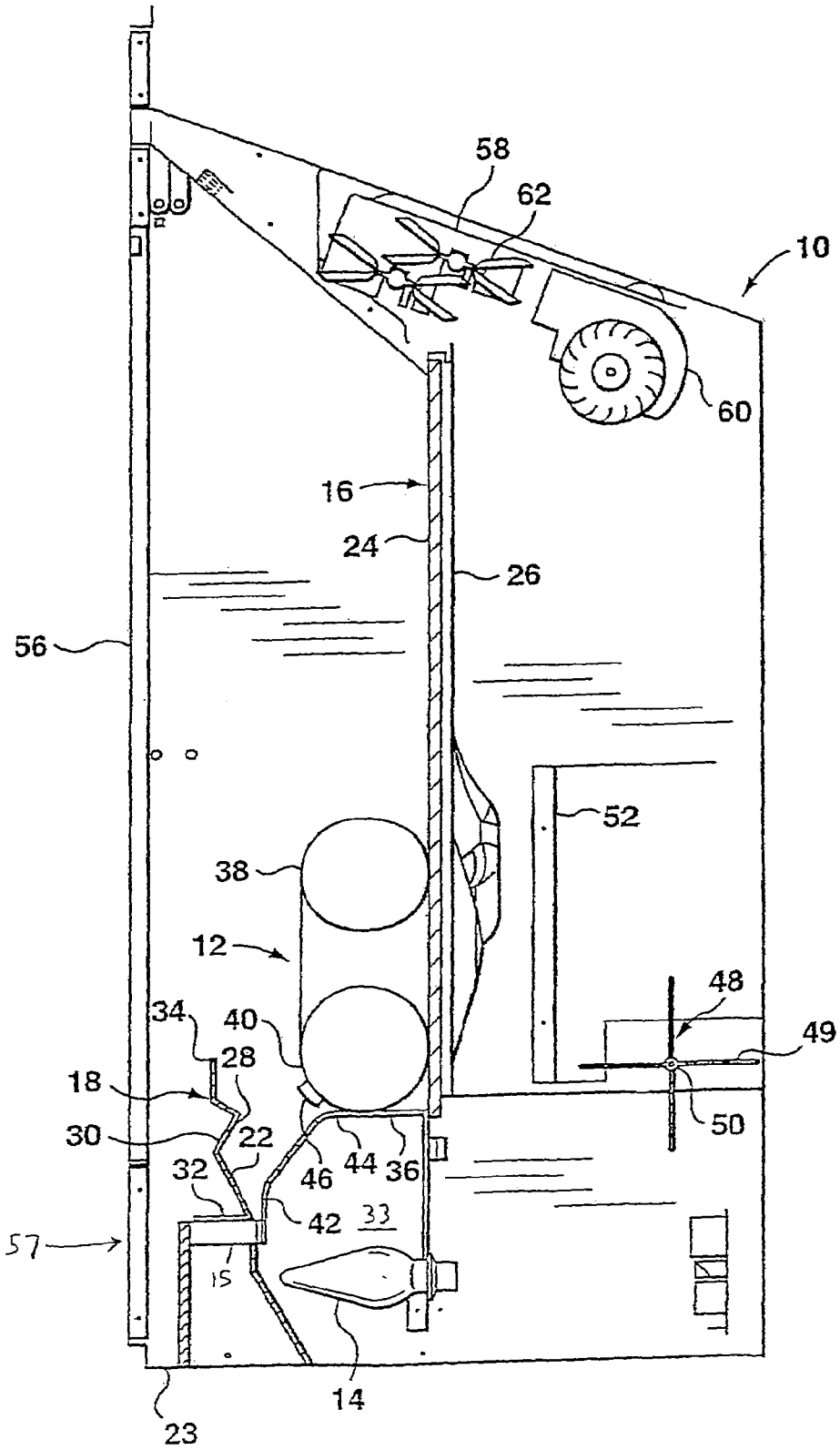
FIG. 3 is a section along line 3—3 of FIG. 2, drawn at a larger scale than FIG. 2.

Reference is first made to FIGS. 1 to 3 to describe the preferred embodiment of a flame simulating assembly indicated generally by the numeral 10 and made in accordance with the invention. The flame simulating assembly 10 includes a simulated fuel bed 12, a light source 14, a screen 16, and a reflector comprising a static reflector 18. As can be seen in FIG. 3, in the preferred embodiment, the reflector 18 is disposed in front of the simulated fuel bed 12 and has a reflective surface 22. The reflective surface 22 is positioned for reflecting light onto the simulated fuel bed 12, as will be described.

The flame simulating assembly 10 is connected to an electrical power source (not shown). As can be seen in FIG. 3, the simulated fuel bed 12, the light source 14, the screen 16, and the reflector 18 are positioned within and fastened to a housing 23. The housing 23 also includes a bottom wall element 15, and the reflector 18 is attached to the bottom wall element 15.

The screen 16 has a front surface comprising a partially reflective front surface 24 for reflecting an image of the simulated fuel bed 12 and for transmitting light from the light source 14 through the partially reflective front surface 24 so that an image of flames appears through the screen 16. In the preferred embodiment, the screen 16 includes a back member 26 disposed behind the partially reflective front surface 24 for diffusing and transmitting light from the light source 14 through the partially reflective front surface 24, as described in U.S. Pat. Nos. 5,642,580, 6,047,489 and 6,363,636, the entire specifications of which are herein incorporated by reference.

Figure 6:
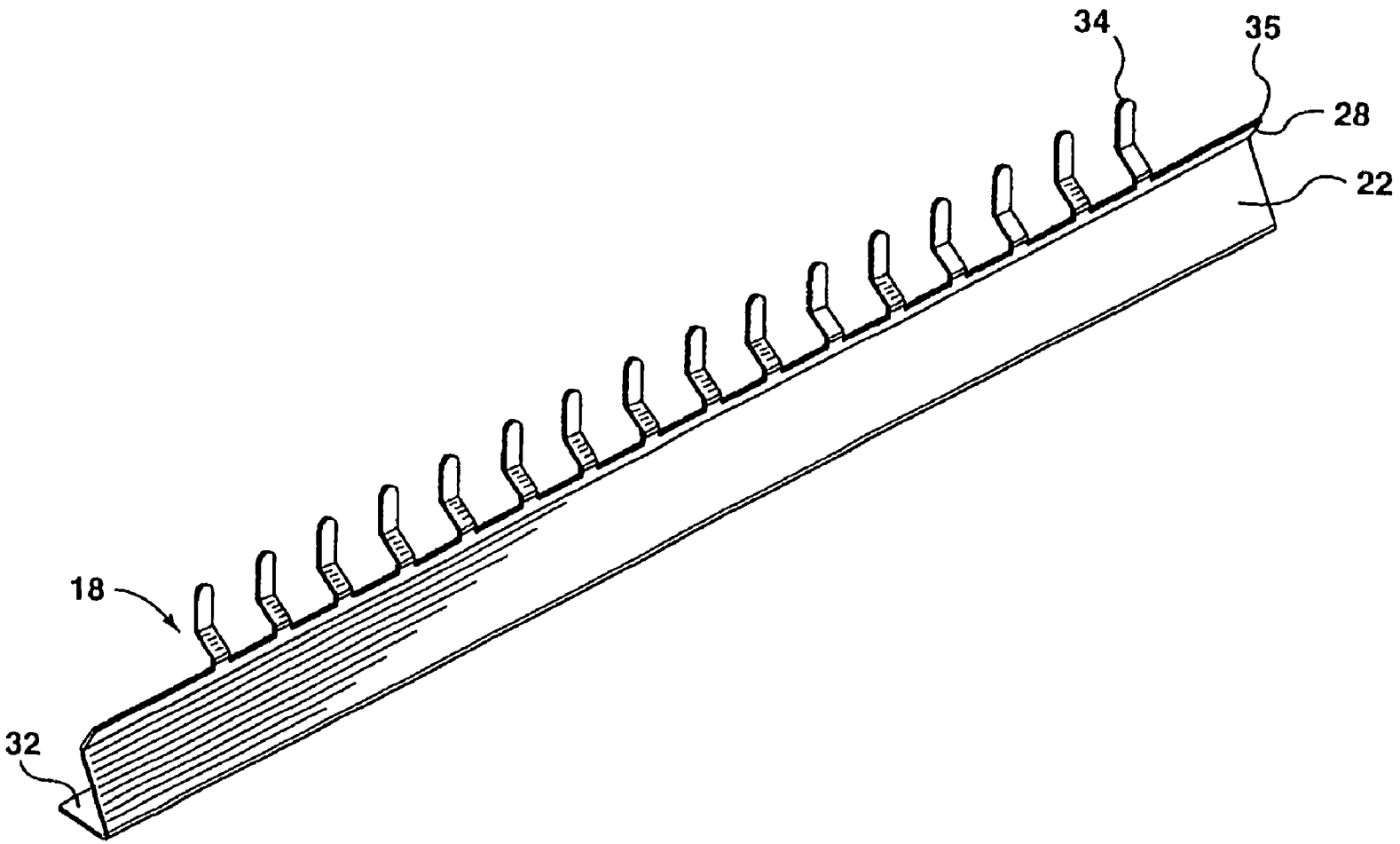
FIG. 6 is an isometric view of the back of the reflector of FIG. 1, drawn at a larger scale than FIG. 1.
Figure 7:
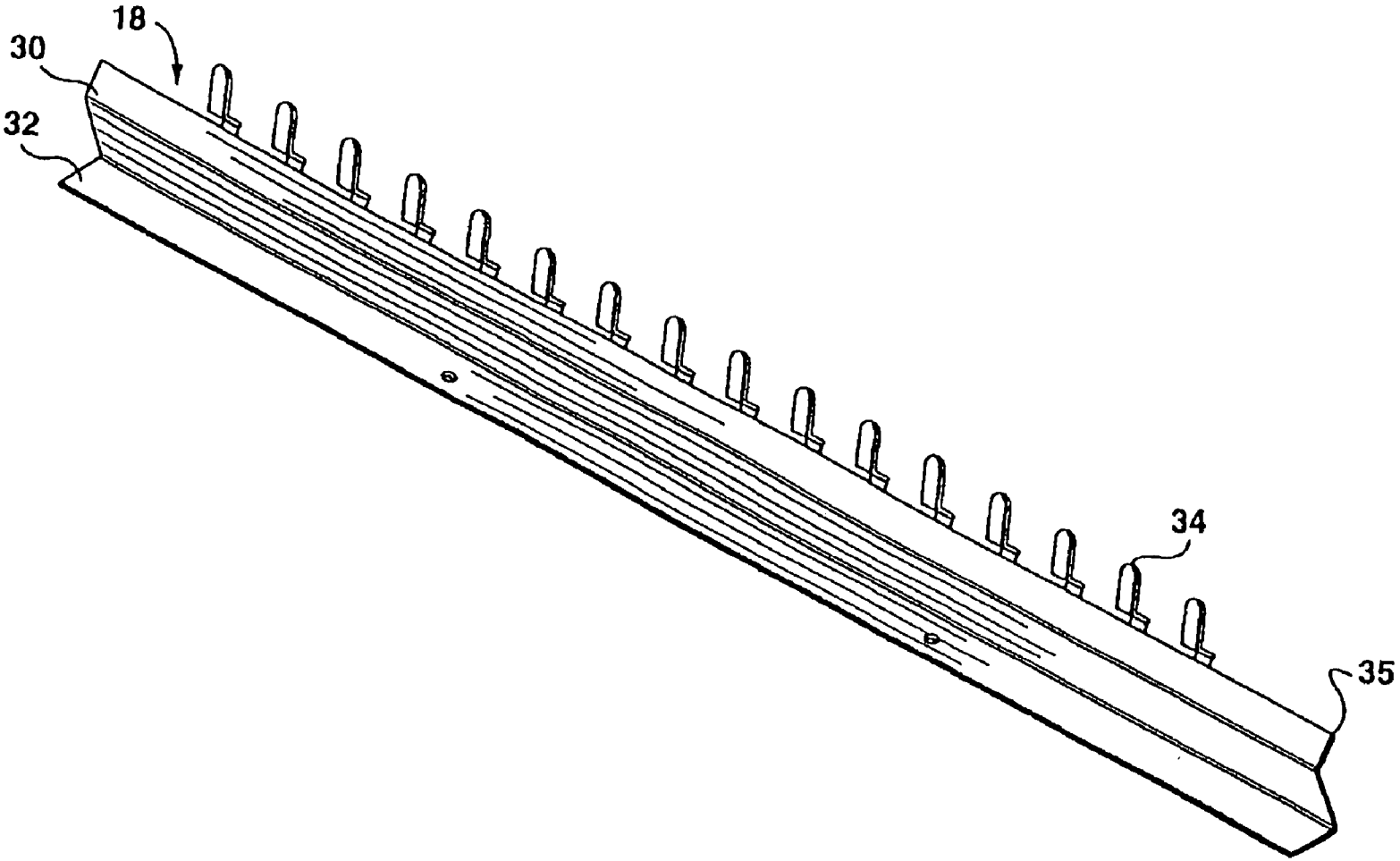
FIG. 7 is an isometric view of the front of the reflector of FIG. 6.

The shape of the preferred embodiment of the reflector 18 is shown in FIGS. 6 and 7. The reflector 18 has an inner side 28 disposed opposite an outer side 30. The inner side 28 is disposed adjacent to the simulated fuel bed 12 and defines the reflective surface 22. As shown in FIG. 7, the reflector 18 preferably has a mounting flange 32 through which fasteners (not shown) are placed, to attach the reflector 18 to the bottom wall element 15. While other arrangements could be employed, the reflector 18 is preferably formed of a single piece of sheet metal of suitable thickness, shaped and cut accordingly. In the preferred embodiment, the shape of the reflector 18 generally is such that, when the reflector 18 is installed in the housing 23, the mounting flange 32 is substantially horizontal, and the reflective surface 22 is positioned for reflecting light from the light source 14 onto the simulated fuel bed 12. As will be described further, because the reflector 18 is disposed outside the simulated fuel bed 12, the positioning of the reflective surface 22 is determined in relation to the simulated fuel bed 12.

Preferably, the reflective surface 22 is finished so that it is substantially reflective. Various arrangements can be employed to achieve the desired reflectivity. In the preferred embodiment, the reflective surface 22 is created by placing the adhesive side of a decal comprising an elongate strip of silvered mylar or other suitable flexible, reflective material on the appropriate part of the inner side 28. Alternatively, the reflective surface 22 can comprise a strip of stainless steel fastened to the inner side 28, finished to enhance reflectivity, or a mirror. The reflective surface 22 preferably extends substantially along the length of the reflector 18, along a lower region of the inner side 28.

Preferably, the outer side 30 of the reflector 18 has a non-reflective finish, so as to resemble a grate which may be used in an actual fireplace in which wood or coal is burned. In order to enhance the effect of the simulated grate, the reflector 18 also preferably includes a plurality of prongs 34, as shown in FIGS. 6 and 7, disposed substantially parallel to each other, extending generally upwardly, and disposed substantially along a central part of the length of an upper edge 35 of the reflector 18. The prongs 34 are shaped and colored to resemble prongs which typically would be found on a grate used in an actual fireplace.

In the preferred embodiment, the simulated fuel bed 12 includes a simulated ember bed 36 and a simulated fuel element, comprising a plurality of simulated logs indicated generally by the numeral 38 as shown in FIGS. 1–5 and 8. It can be seen in FIGS. 1 2, 3, and 8 that the simulated logs 38 are disposed above the simulated ember bed 36. Although the simulated logs 38 resemble logs of wood, the simulated fuel element can, alternatively, resemble a plurality of lumps of coal (not shown).

The simulated ember bed 36 preferably is a plastic shell which is vacuum formed and colored in accordance with the simulated fuel element. For example, if the simulated fuel element is a plurality of simulated logs 38, as shown in FIGS. 1–5 and 8, then the simulated ember bed 36 is accordingly shaped and colored to resemble burning logs and burning embers thereon and thereunder forming a base of a fire in which the burning fuel is logs of wood. Alternatively, if the simulated fuel element were formed to resemble lumps of coal, then the simulated ember bed 36 would be accordingly shaped and colored to resemble a plurality of burning lumps of coal and burning embers, forming the base of a coal fire. In the preferred embodiment, the simulated logs 38 include a plurality of generally downwardly directed portions 40. The downwardly directed portions 40 correspond to the lower sides of real logs in a real fire. As will be described, the reflective surface 22 of the reflector 18 is preferably positioned for reflecting light from the light source 14 onto the downwardly directed portions 40.

Preferably, the simulated ember bed 36 is seated directly on the bottom wall element 15 (FIG. 3), or otherwise attached to the bottom wall element 15 by any suitable means. As can be seen in FIG. 3, the simulated ember bed 36 is generally positioned above the bottom wall element 15. The simulated ember bed 36 and the bottom wall element together define, at least in part, a compartment 33 (FIGS. 3, 8, 9, 10, 11, 12, 13, 15, 16). The light source 14 is preferably located in the compartment 33.

Figure 4:
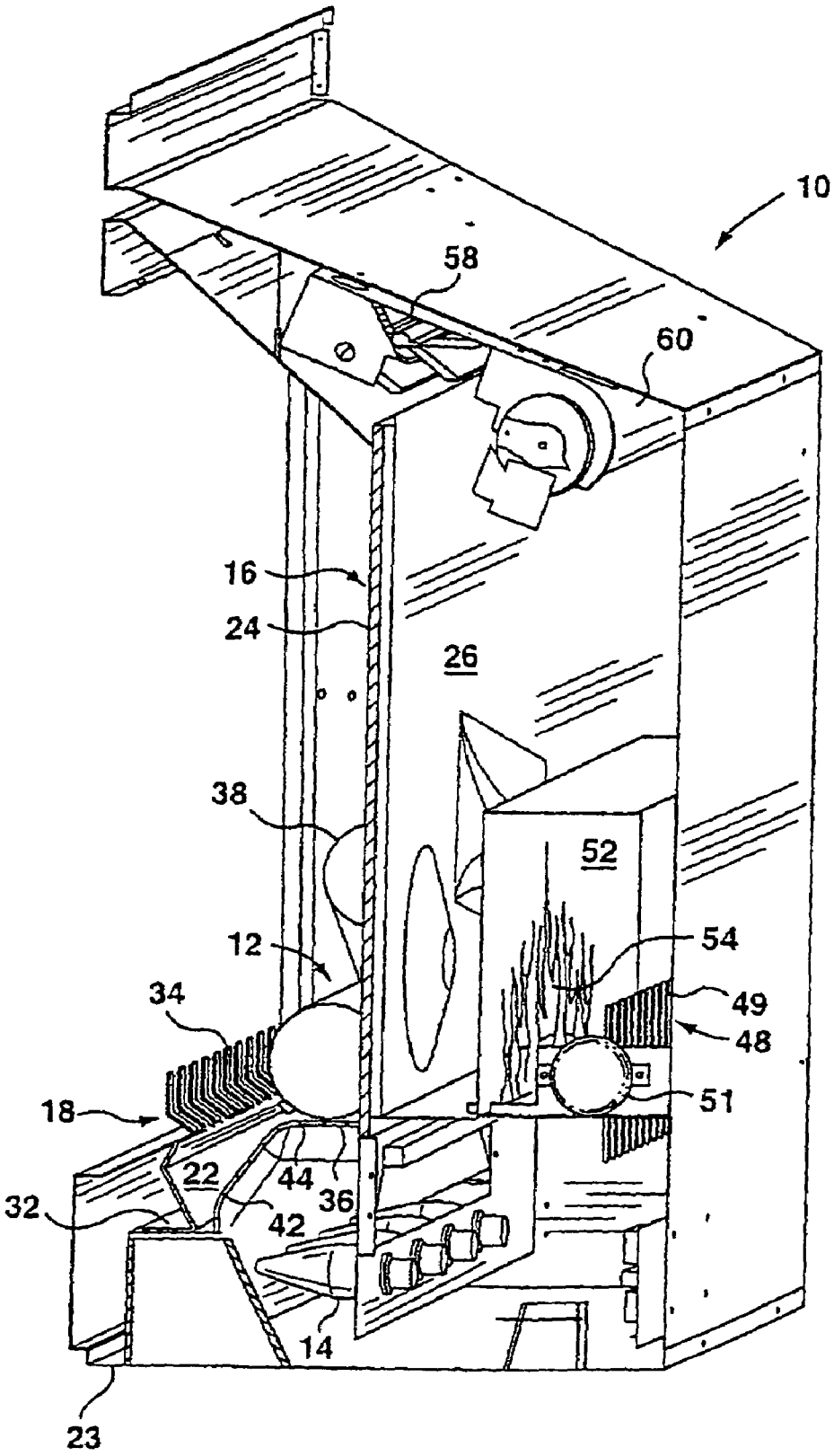
FIG. 4 is an isometric partly sectional view of the flame simulating assembly of FIG. 1, drawn at a larger scale than FIG. 1.
Figure 8:
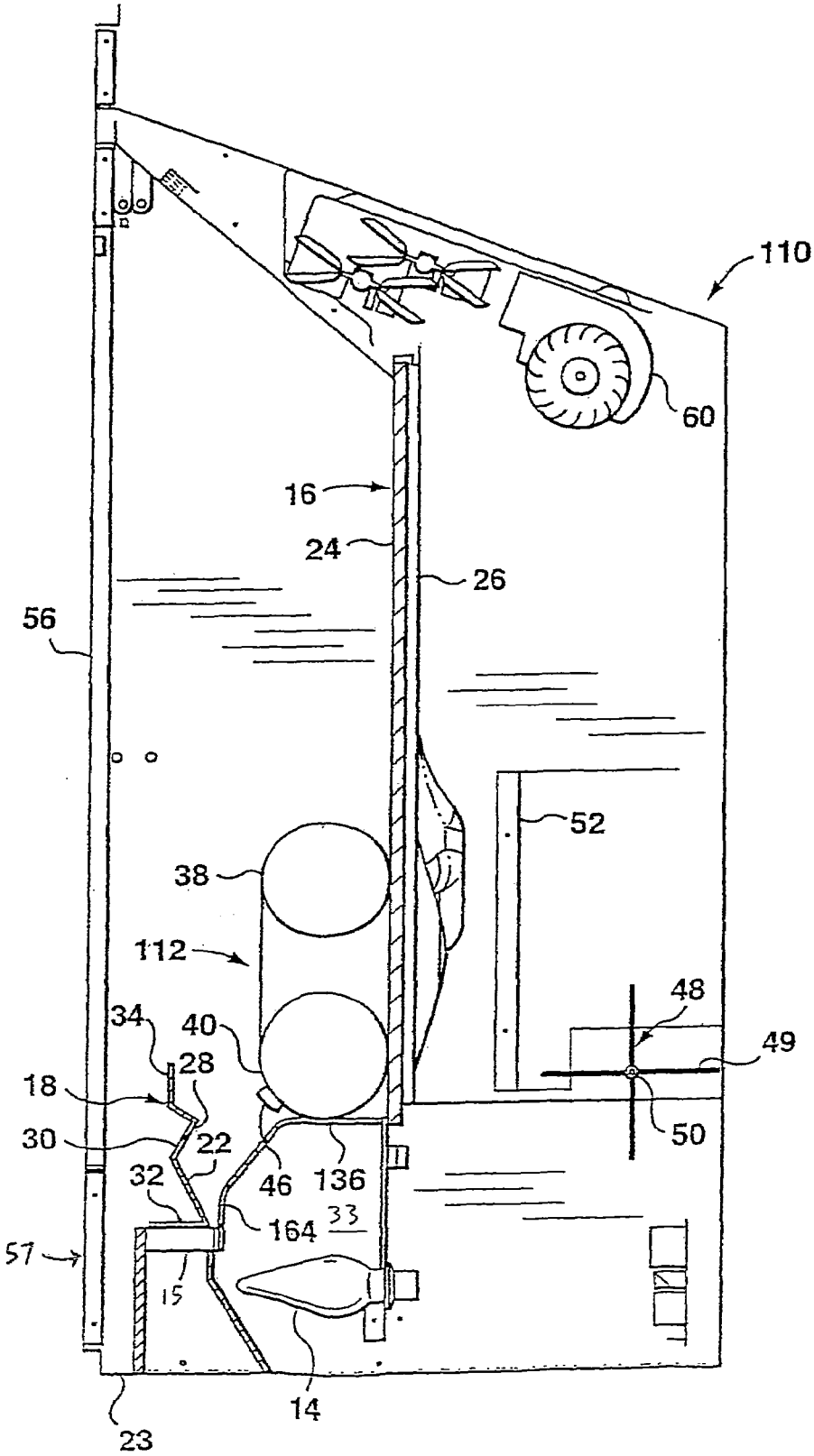
FIG. 8 is a sectional side view, similar to FIG. 3, of another embodiment of the flame simulating assembly according to the invention.

As can be seen in FIGS. 3, 4 and 8, the reflector 18 is positioned outside the simulated fuel bed 12. In particular, the reflector 18 is positioned outside the compartment 33. Also, in the preferred embodiment, the light source 14 is positioned below the simulated fuel bed 12. In the preferred embodiment, and as shown in FIGS. 3 and 4, the simulated ember bed 36 includes a translucent portion 42 positioned in a path of light from the light source 14 to the reflective surface 22. Light from the light source 14 is permitted to pass through the translucent portion 42 to the reflective surface 22, and is reflected from the reflective surface 22 onto the simulated fuel bed 12 to simulate burning embers.

Figure 5:
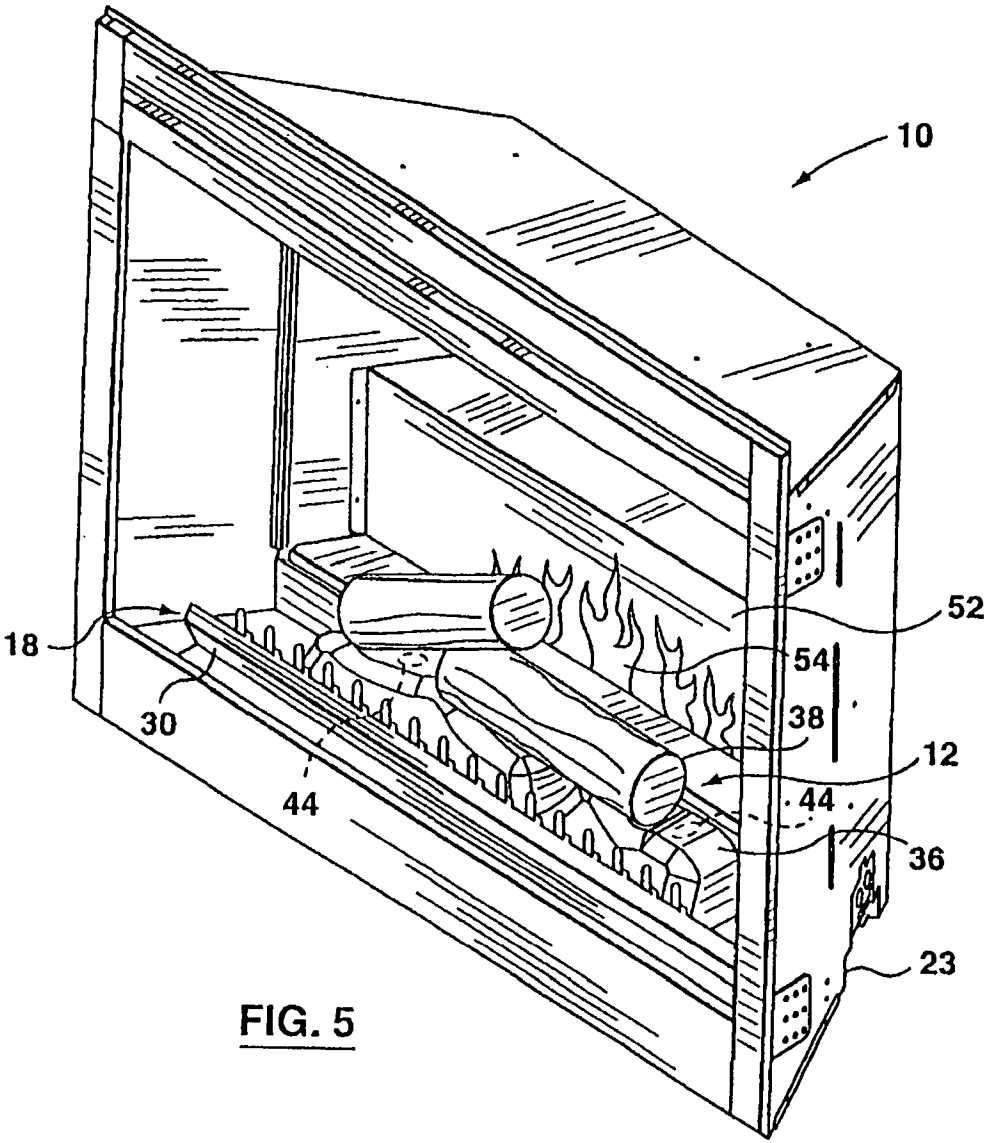
FIG. 5 is an isometric view of the flame simulating assembly of FIG. 1, with the screen removed.

In addition, the simulated ember bed 36 preferably also includes a plurality of translucent regions 44 disposed and colored so that the translucent regions 44 resemble burning embers when light from the light source 14 passes through them. Preferably, the translucent regions 44 are positioned so that they are at least partly viewable by an observer. By way of example, the translucent regions 44 are shown in FIGS. 1 and 5.

Depending on the burning fuel which the simulated fuel bed 12 is intended to resemble, any suitable shades of the colors yellow, red, and orange, and any suitable mixtures or combinations of any of such colors, may be used in the translucent portion 42 or the translucent regions 44, or the reflective surface 22. Also, the light source 14 may be colored, to result in light from the light source 14 having a desired color. The term reddish, as used herein, refers to any suitable combination of colors used in the flame simulating assembly to simulate burning embers. As will be described, preferably, the translucent portion 42 and the translucent regions 44 are reddish in color, however, the translucent portion 42 or the translucent regions 44 can include one or more other colors.

Due to the positioning of the reflector 18 relative to the translucent portion 42, the observer's view of the translucent portion 42 is generally obscured by the outer side 30 of the reflector 18. Because of this, the coloring of the translucent portion 42 can be any color suitable for achieving the desired coloring of light from the light source 14 reflected from the reflective surface 22 onto the simulated fuel bed 12. In comparison, those parts of the simulated ember bed 36 which are directly viewable by the observer when the flame simulating assembly 10 is in use are shaped and colored to resemble the base of a wood or coal fire, as the case may be.

In the preferred embodiment, the simulated logs 38 include a plurality of partially reflective parts comprising a plurality of ember decals 46, as can be seen in FIGS. 3 and 8. Preferably, the ember decals 46 are positioned on the downwardly directed portions 40 of the simulated logs 38. The ember decals 46 are as described in more detail in U.S. Pat. No. 6,162,047, the entire specification of which is herein incorporated by reference. Light from the light source 14 is reflected onto the ember decals 46 from the reflective surface 22, and the ember decals 46 are therefore positioned on the downwardly directed portions 40 so as to maximize the reflection of light by the ember decals 46. The ember decals 46 reflect light from the light source 14 which is reflected onto the ember decals 46 from the reflective surface 22 accordingly, to simulate burning embers. When the ember decals 46 reflect light from the light source as described, the ember decals 46 thereby cause a glow to emanate from the downwardly directed portions 40, simulating burning embers, and thus contribute to the overall simulation effect of the flame simulating assembly 10.

As noted above, in the preferred embodiment, color is used, particularly in the simulated fuel bed 12, to enhance the simulation of burning embers. Preferably, the ember decals 46 are reddish in color. Because the color of the light which is reflected onto the ember decals 46 from the reflective surface 22 affects the color of the light which glows from the ember decals 46 on the downwardly directed portions 40, the color of the translucent portion 42, and any coloring included in the reflective surface 22, are also to be considered when determining the coloring of the ember decals 46.

The preferred embodiment of the flame simulating assembly also includes a flicker element 48 positioned in a path of light transmitted from the light source 14 to the back member 26, for causing the light from the light source 14 transmitted to the back member 26 to flicker, or fluctuate. Preferably, and as disclosed in U.S. Pat. No. 5,642,580, the flicker element 48 comprises a plurality of strips 49 of substantially reflective material disposed around an axis 50 and extending radially outwardly from the axis 50. When the flame simulating assembly is operating, the flicker element 48 is rotated about the axis 50 by an electric motor 51. As the flicker element 48 is rotated about its axis 50 by the electric motor 51, the reflective strips 49 intermittently reflect light from the light source 14, so that the flicker element 46 causes light from the light source 14 which is transmitted to the flicker element 46 to flicker, or fluctuate.

The preferred embodiment also includes a flame effect element 52. As described in more detail in U.S. Pat. No. 6,047,489, in the preferred embodiment, the flame effect element 52 is preferably made of sheet metal or any other suitable material. The flame effect element 52 is positioned in a path of flickering light from the light source 14 which has been reflected by the flicker element 46, and the flame effect element 52 configures the flickering light. Although various arrangements can be employed, preferably, a flame pattern is cut into sheet metal to provide one or more openings 54. If one opening 54 is used, the opening configures the flickering light into an image of flames, as can be seen in FIGS. 4 and 5. As a result, an image of flickering flames is transmitted through the partially reflective front surface 24.

Preferably, the flame simulating assembly 10 also includes an observation zone (preferably a transparent front panel 56) in a front wall 57 of the housing 23. The front panel 56 can be removed to permit access to other parts of the flame simulating assembly 10.

While other arrangements could be employed, as shown in FIGS. 3 and 4, the light source 14 comprises a plurality of electric light bulbs, operatively connected to a source of electricity. Alternatively, the light source 14 could be, for example, a natural gas flame (not shown). If the light source 14 is a natural gas flame, the materials used in the flame simulating assembly 10 would have to be heat-resistant to the extent necessary. In the embodiments described, the light source 14 is a plurality of electric light bulbs.

In use, light from the light source 14 is transmitted through the translucent portion 42 to the reflective surface 22, and reflected from the reflective surface 22 onto the simulated fuel bed 12. In the preferred embodiment, light from the light source 14 which has been so reflected is also reflected onto the ember decals 46, and the light reflected from the ember decals 46 simulates burning embers disposed on the downwardly directed portions 40 of the simulated logs 38. Preferably, the translucent portion 42 and the ember decals 46 are reddish in color, so that a reddish glow emanates from the ember decals 46 when light from the light source 14 is reflected onto the ember decals 46 by the reflective surface 22. The result is an improved simulation of burning embers due to the positioning of the reflector 18 outside the compartment 33.

In addition, light from the light source 14 also passes through the translucent regions 44 on the simulated ember bed 36, which also resemble glowing embers. At the same time, light from the light source 14 is reflected intermittently by the strips 49 in the flicker element 48 to the flame effect element 52. The flickering light is also configured by the flame effect element 52 so that an image of flames is transmitted through the partially reflective front surface 24.

Preferably, the flame simulating assembly 10 additionally includes a heater 58 providing heated air, and a blower 60 for blowing the heated air into the premises in which the flame simulating assembly 10 is disposed. As can be seen in FIGS. 3 and 8, the heater 58 can comprise a plurality of heating elements 62.

Additional embodiments of the invention are shown in FIGS. 8–16. In FIGS. 8–16, elements are numbered so as to correspond to like elements shown in FIGS. 1 through 7.

In the embodiment shown in FIG. 8, a flame simulating assembly 110 includes a simulated ember bed 136 having a plurality of apertures 164, only one of which is shown in FIG. 8, the apertures 164 being positioned in a path of light from the light source 14 to the reflective surface 22. As in the preferred embodiment, the reflective surface 22 is positioned for reflecting light from the light source 14 onto a simulated fuel bed 112. In use, light from the light source 14 is transmitted through the apertures 164 to the reflective surface 22, and reflected onto a plurality of ember decals 46 from a reflective surface 22. Preferably, the ember decals 46 are reddish in color, so that they simulate burning embers when light from the light source 14 is reflected onto the ember decals 46 from the reflective surface 22.

Figure 9:
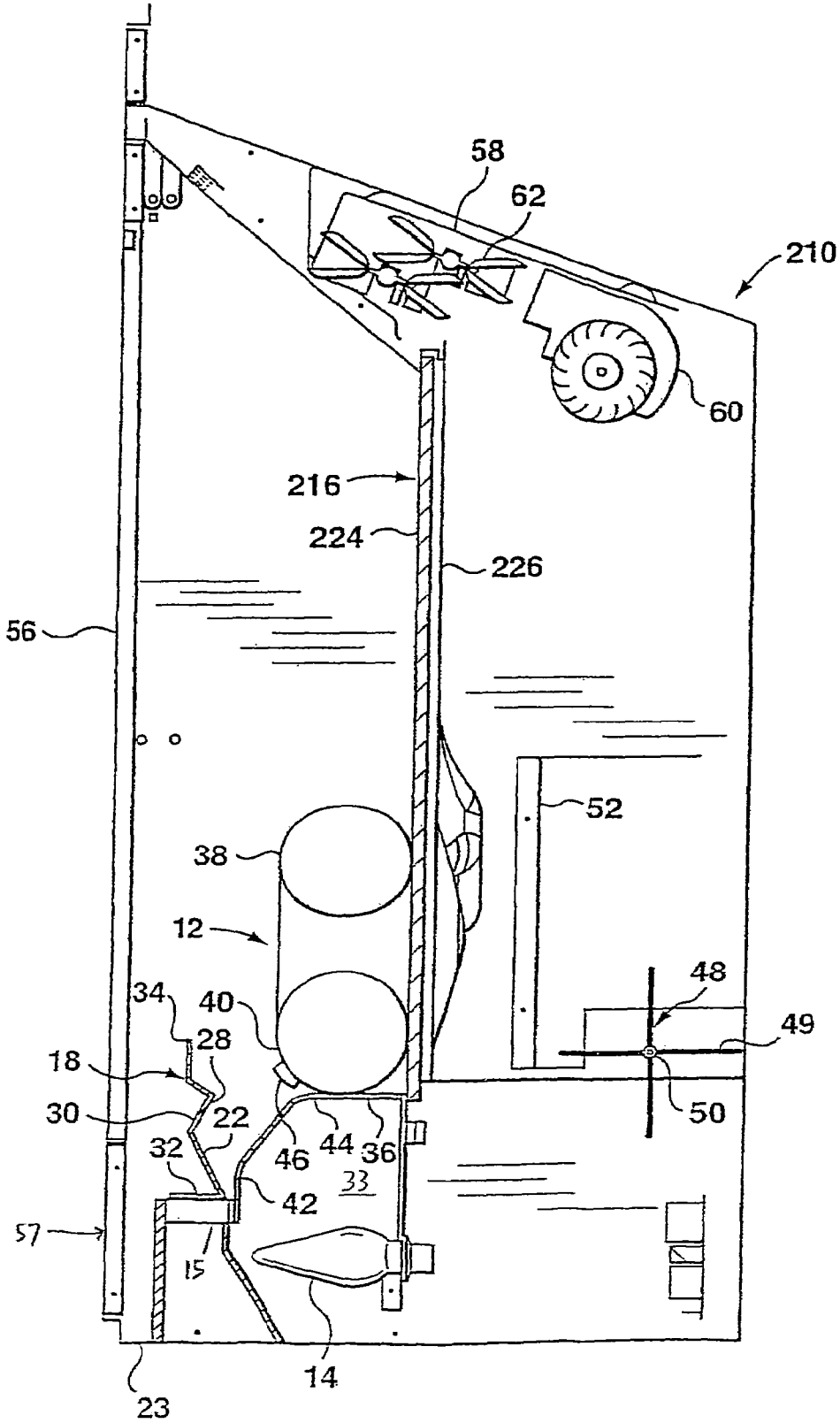
FIG. 9 is a sectional side view, similar to FIG. 3, of another embodiment of the flame simulating assembly according to the invention.

In FIG. 9, another embodiment of the flame simulating assembly 210 is shown in which a screen 216 has a front surface 224 for transmitting light from the light source 14 so that an image of flames appears through the screen 216. Unlike the partially reflective front surface 24 included in the preferred embodiment, the front surface 224 is non-reflective, however, the front surface 224 transmits light. The screen 216 also includes a back member 226, disposed behind the front surface 224. The back member 226 is for diffusing and transmitting light from the light source 14 through the front surface 224. In use, as in the preferred embodiment, light from the light source 14 is transmitted through the translucent portion 42 to the reflective surface 22, and reflected onto the simulated fuel bed 12 by the reflective surface 22.

Figure 10:
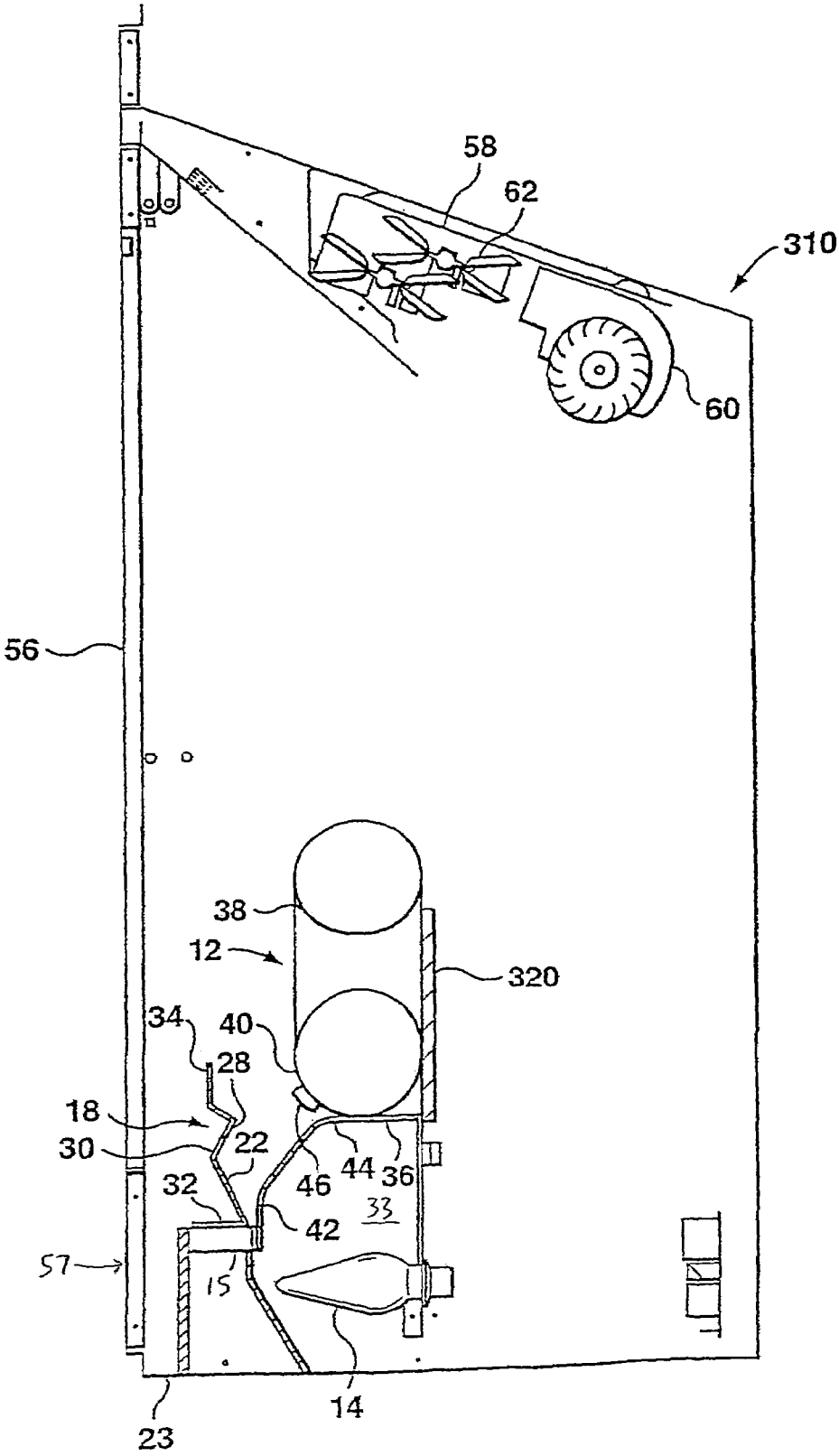
FIG. 10 is a sectional side view, similar to FIG. 3, of another embodiment of the flame simulating assembly according to the invention.

Another embodiment is shown in FIG. 10, in which a flame simulating assembly 310 shown in FIG. 10 includes a support member 320 for supporting the simulated logs 38. As can be seen in FIG. 10, the simulated logs 38 are also supported by the simulated ember bed 36. This embodiment does not include elements corresponding to a screen 16, a flame effect element 52, or a flicker element 48. In use, and as in the preferred embodiment, light from the light source 14 is transmitted through the translucent portion 42 to the reflective surface 22, and reflected onto the simulated fuel bed 12 by the reflective surface 22.

Figure 11:
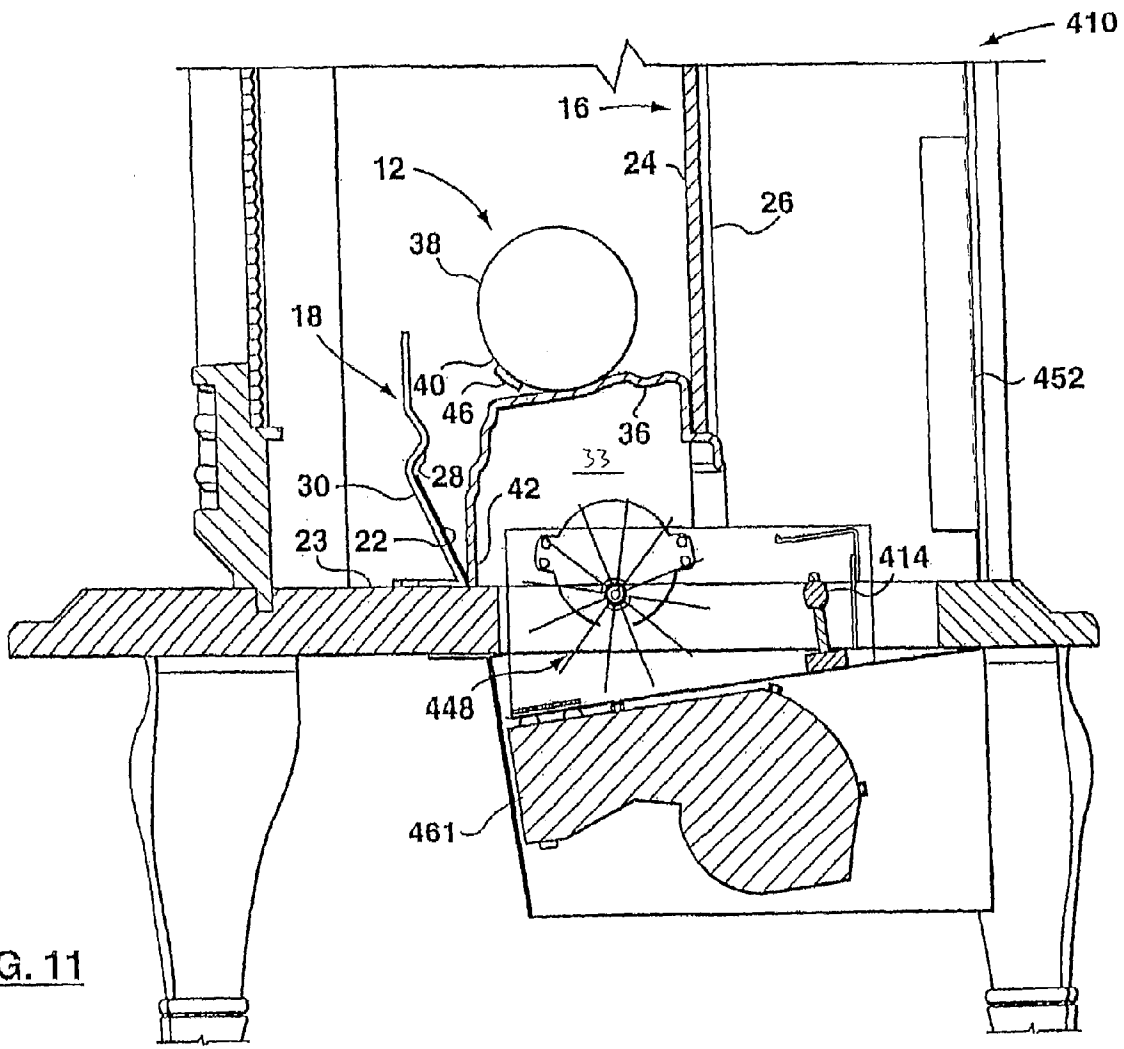
FIG. 11 is a partial sectional side view of another embodiment of the flame simulating assembly according to the invention.
Figure 12:
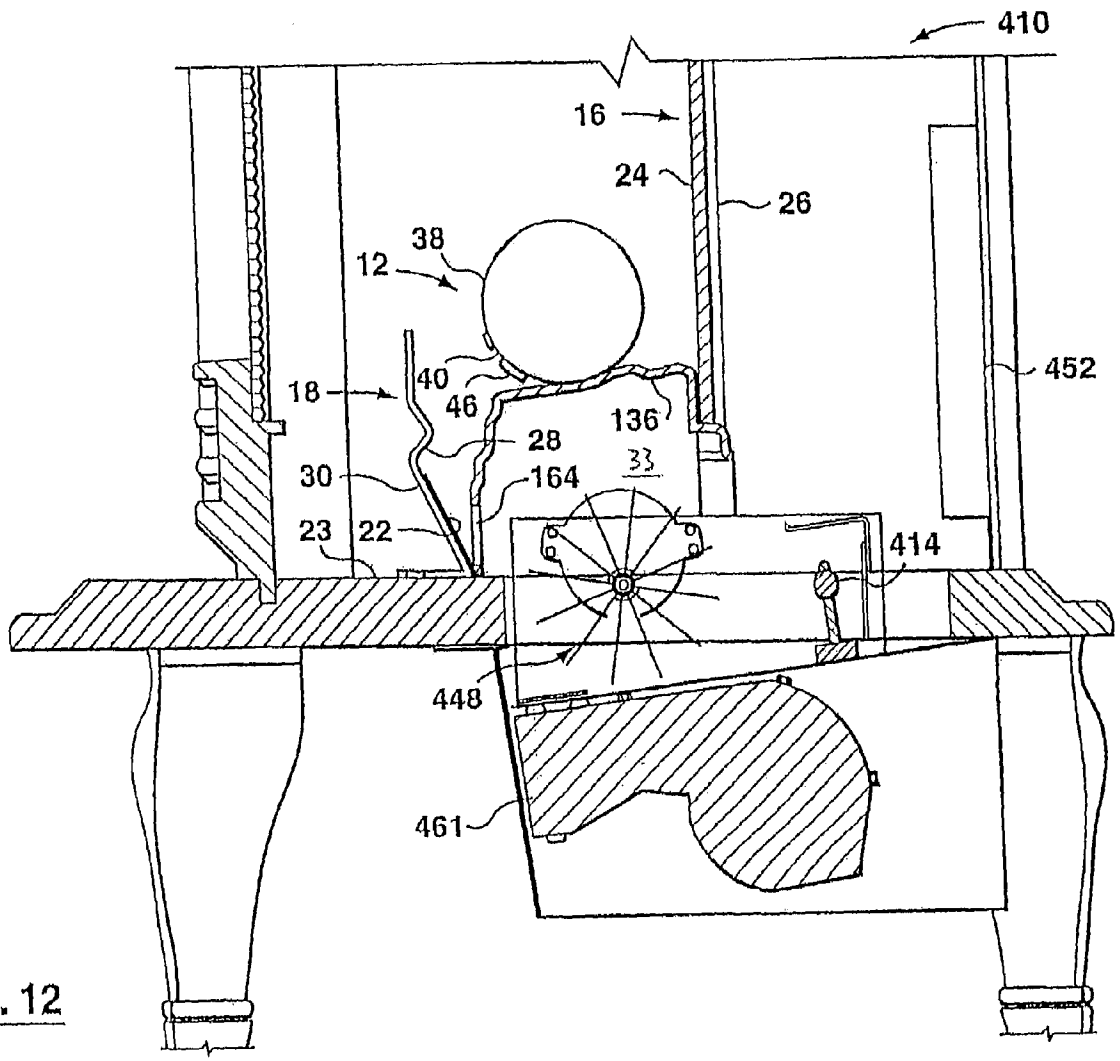
FIG. 12 is a partial sectional side view, similar to FIG. 11, of another embodiment of the flame simulating assembly of the invention.

As can be seen in FIGS. 3, 4, and 9, in the embodiments shown in those drawings, the light source 14 is positioned below the simulated ember bed 36 and the flicker element 48 is positioned behind the light source 14. In the embodiments shown in FIGS. 11 and 12, a flicker element 448 is positioned below the simulated ember bed 36 (or simulated ember bed 136, in FIG. 12) and the light source 414 is positioned behind the flicker element 440. In FIGS. 11 and 12, elements are numbered so as to correspond to like elements shown in FIGS. 1 through 7.

In the embodiment shown in FIG. 11, a flame simulating assembly 410 includes the simulated ember bed 36 with the translucent portion 42. The translucent portion 42 and the flicker element 448 are positioned in a path of light from the light source 414 to the reflective surface 22 on the reflector 18. Light from the light source 414 is transmitted through the translucent portion 42 and reflected by the reflective surface 22 onto the simulated fuel bed 12. Preferably, light from the light source 414 which is transmitted to the reflective surface 22 is reflected onto the ember decals 46 positioned on the downwardly directed portions 40 of the simulated logs 38, to simulate burning embers.

In the flame simulating assembly 410, light from the light source 414 is also reflected by the flicker element 448 onto a flame effect element 452 which configures the light to transmit an image of flickering flames through the partially reflective front surface 24 of the screen 16. The flame effect element 452 includes a reflective surface (not shown) shaped into an image of flames, rather than one or more openings. In the flame effect element 452, the reflective surface configures light from the light source 414 and reflected by the flicker element 448 to transmit an image of flames through the partially reflective front surface 24. The flame simulating assembly 410 also includes a heater and blower unit 461.

In FIG. 12, another embodiment of the flame simulating assembly 410 is shown in which the simulated ember bed 36 includes a plurality of apertures 164 positioned, along with the flicker element 448, in a path of light from the light source 414 to the reflective surface 22. Light from the light source 414 is transmitted through the apertures 164 and reflected from the reflective surface 22 onto the simulated fuel bed 112.

Figure 13:
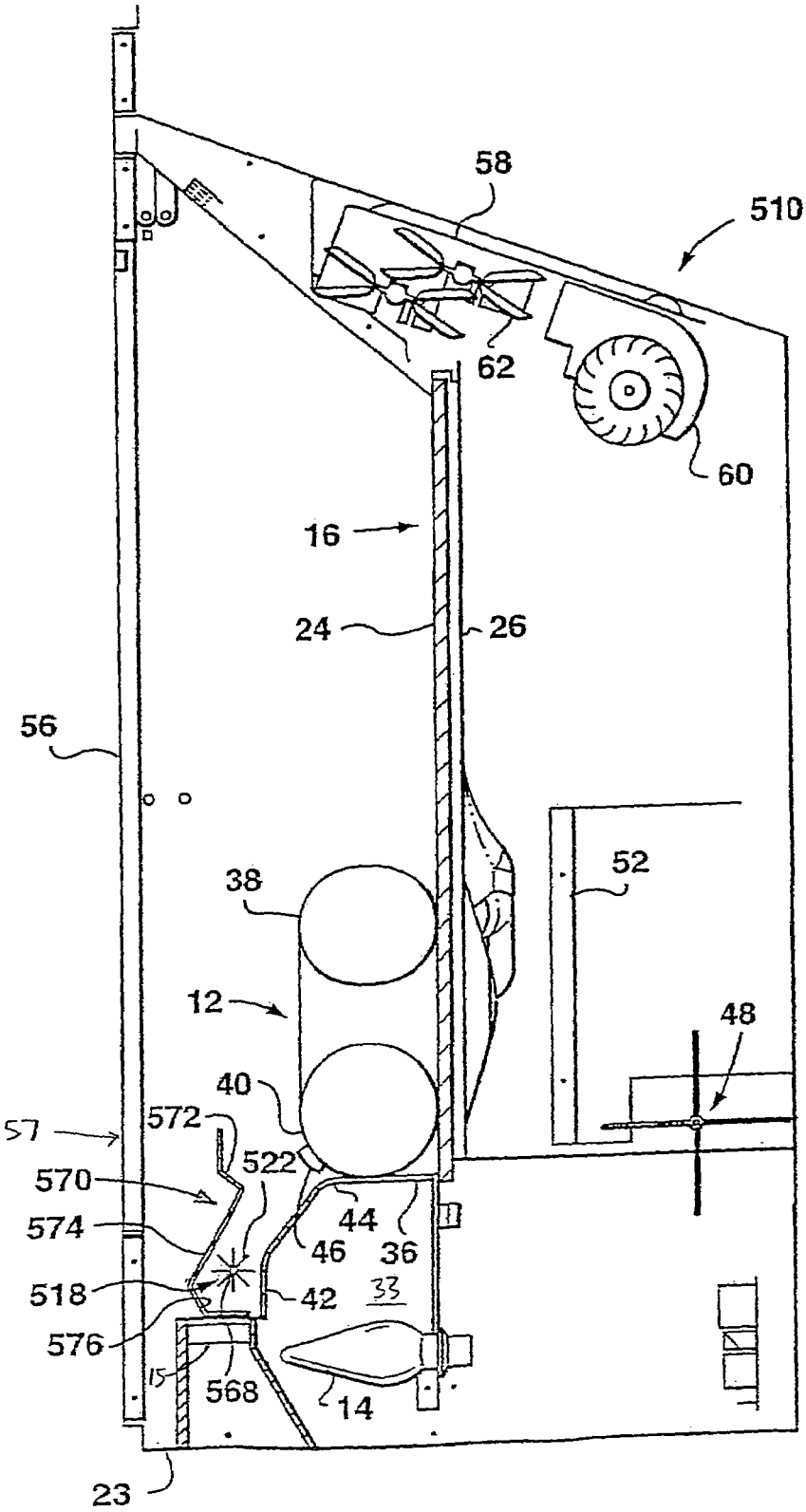
FIG. 13 is a sectional side view, similar to FIG. 3, of yet another embodiment of the flame simulating assembly according to the invention, including a dynamic reflector.

An additional embodiment of a flame simulating assembly 510 is shown in FIG. 13. In this embodiment, a dynamic reflector 518 is positioned in front of the simulated fuel bed 12, specifically, between the simulated ember bed 36 and the front wall 57. As can be seen in FIG. 13, the dynamic reflector 518 is also above the bottom wall element 15 and outside the compartment 33. The dynamic reflector 518 includes a plurality of reflective surfaces 522, as will be described. The translucent portion 42 of the simulated ember bed 36 is positioned in a path of light from the light source 14 to the reflective surfaces 522. Light from the light source 14 transmitted through the translucent portion 42 is reflected from the reflective surfaces 522 onto the simulated fuel bed 12. As will be described, the dynamic reflector 518 is adapted for movement relative to the simulated fuel bed 12.

Figure 14:
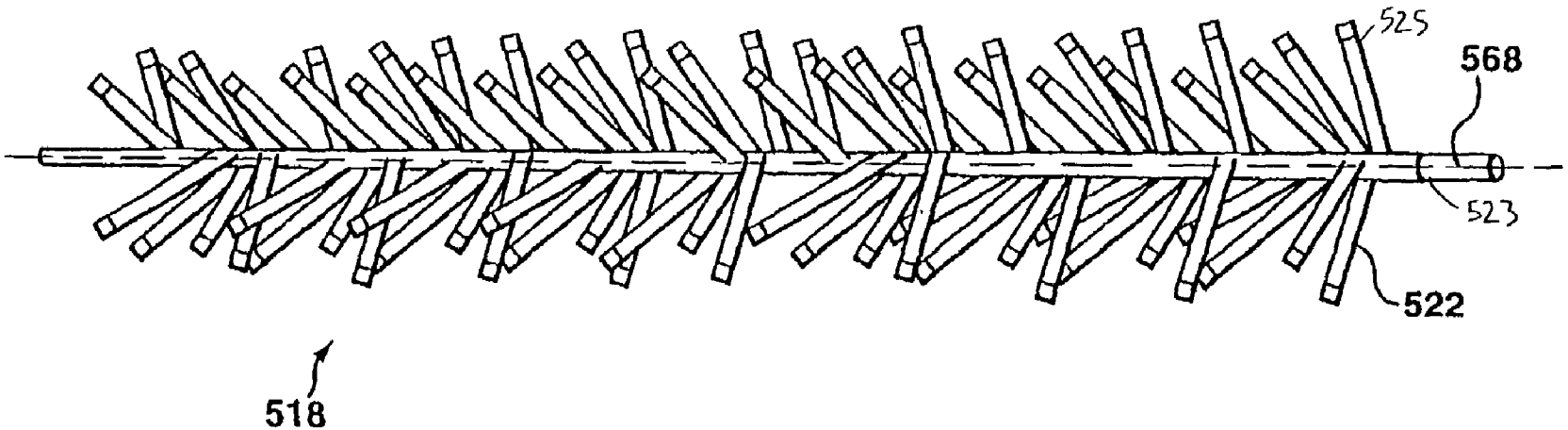
FIG. 14 is a top view of the preferred embodiment of a dynamic reflector, drawn at a larger scale than FIG. 11.

In the preferred embodiment, the dynamic reflector 518 includes an elongate rod 523 defining an axis 568 (FIG. 14). The reflective surfaces 522 preferably are the surfaces of strips of silvered mylar 525 attached to the rod 523 in any suitable manner, or any other suitable material. Preferably, the mylar strips 525 extend radially outwardly from the rod 523. The dynamic reflector 518 is mounted within the housing 23, generally in front of the simulated fuel bed 12, in any suitable manner which permits rotation of the rod 523 and, consequently, the rotation of the reflective surfaces 522 about the axis 568.

In use, the dynamic reflector 518 is positioned substantially in front of the simulated fuel bed 12, and the reflective surfaces 522 rotate about the axis 568. Preferably, the rod 523 is rotated by means of an electric motor (not shown) attached to the rod 523 as is known in the art, causing the rod 523 to rotate at a predetermined rate about the axis 568. However, any other suitable means may be used to rotate the rod 523. As noted above, the dynamic reflector 518 is positioned in a path of light between the light source 14 and the simulated fuel bed 12. The dynamic reflector 518 thus provides an additional flickering light reflected onto the simulated fuel bed 12 to simulate flickering light provided by flames in a natural fire (not shown) which may be at least partially directed onto a fuel bed (not shown) for the natural fire.

Also, the dynamic reflector 518 can provide a simulation of burning embers in the simulated fuel bed 12. For example, light from the light source 14 is reflected by the dynamic reflector 518 onto ember decals 46 positioned on simulated fuel elements 38 (FIG. 13). The ember decals 46 provide a glowing effect when light is directed onto them. Accordingly, the flickering light provided by the dynamic reflector 518 creates a flickering, glowing light when reflected onto the ember decals 46.

The flame simulating assembly 510 preferably includes a simulated grate 570, which is disposed in front of the dynamic reflector 518. The simulated grate 570 has an inner side 572 disposed opposite an outer side 574, the inner side 572 being disposed adjacent to the dynamic reflector 518. Preferably, the inner side 572 has a static reflective surface 576 positioned thereon. Light from the light source 14 is transmitted through the translucent portion 42 and reflected by the reflective surfaces 522 and the static reflective surface 576 onto the simulated fuel bed 12.

In the preferred embodiment, the flame simulating assembly 510 includes a bottom wall element 15 (FIG. 13). The simulated ember bed 12 and the bottom wall element 15 at least partially define a compartment 33 located substantially inside the simulated ember bed 36. The simulated ember bed 36 includes a front portion 42 positioned in a path of light between the light source 14 and the dynamic reflector 510. The front portion 42 is adapted to permit light to be transmitted therethrough (as described above), and preferably is translucent. Preferably, the flame simulating assembly 510 also includes a front wall 57 which includes an observation zone 56 and is positioned in front of the simulated ember bed 12 and the screen generally. As described above, the observation zone 56 permits observation of the simulated fuel bed 12. The dynamic reflector 518 is positioned above the bottom wall element 15, outside the compartment 33, and between the simulated ember bed 36 and the front wall 57. The dynamic reflector 518 is positioned in the path of light from the light source 14, for reflecting light from the light source 14 onto the simulated fuel elements 38. The dynamic reflector 518 is adapted so that the reflective surfaces 522 rotate about the axis 568, causing light from the light source 14 to flicker and to be reflected onto the simulated fuel bed 12 thereby providing an improved fire simulation effect.

Figure 15:
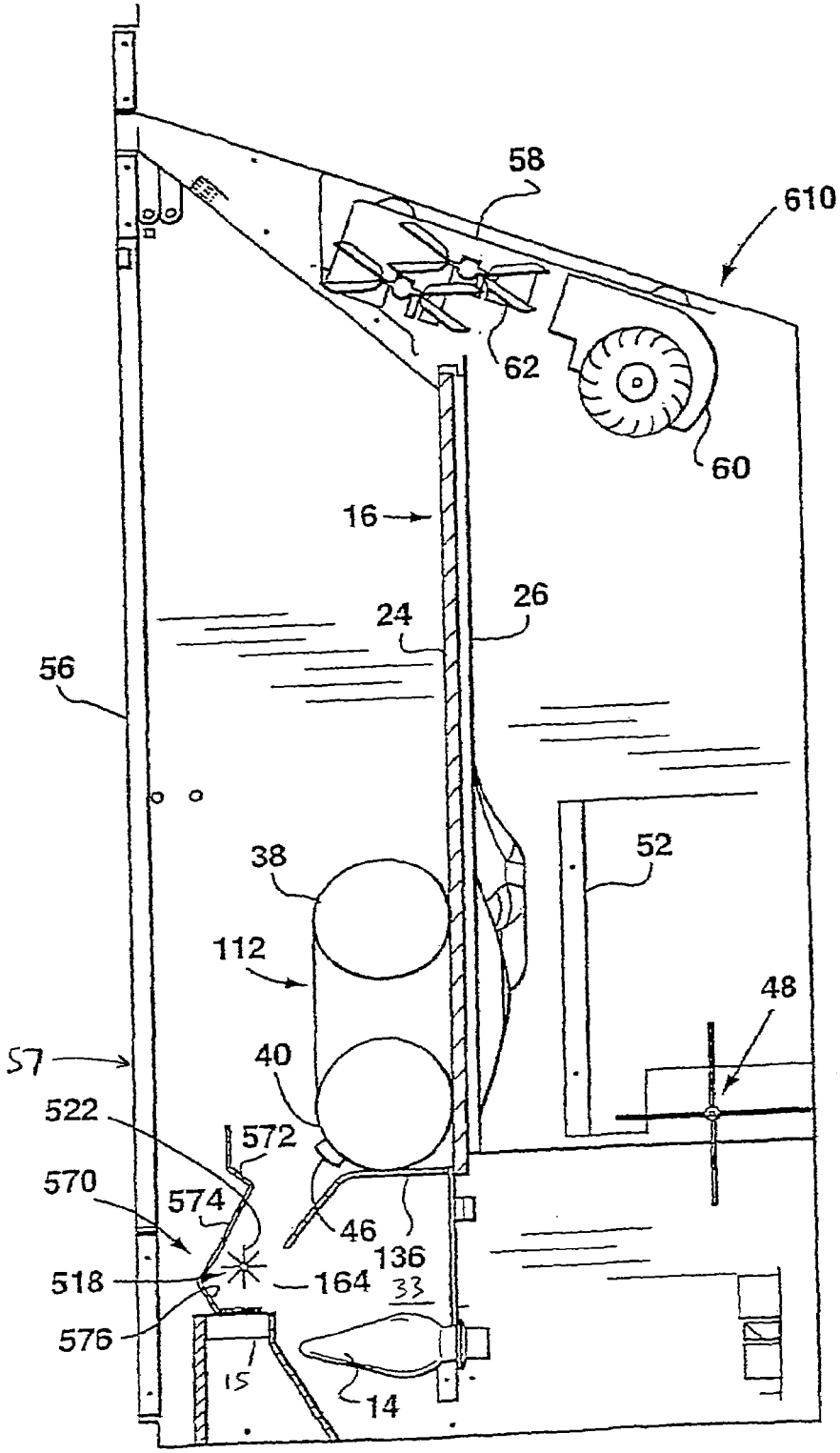
FIG. 15 is a sectional side view, similar to FIG. 3, of another embodiment of the flame simulating assembly according to the invention.

FIG. 15 shows yet another embodiment of a flame simulating assembly 610. In this embodiment, the simulated ember bed 112 includes a plurality of apertures 164 positioned in a path of light from the light source 14 to the dynamic reflector 518. Light from the light source 14 is transmitted through the apertures 164 and reflected from the reflective surfaces 522 and the reflective surface 576 onto the simulated fuel bed 112.

It will be appreciated that different versions of the embodiments shown in FIGS. 13 and 15 can be constructed by positioning the flicker element 48 under the simulated fuel bed 12 (or under the simulated fuel bed 112, in FIG. 15, as the case may be) and positioning the light source 14 behind the flicker element 48, similar to the arrangement of the flicker element 448 and the light source 414 shown in FIGS. 11 and 12.

Figure 16:
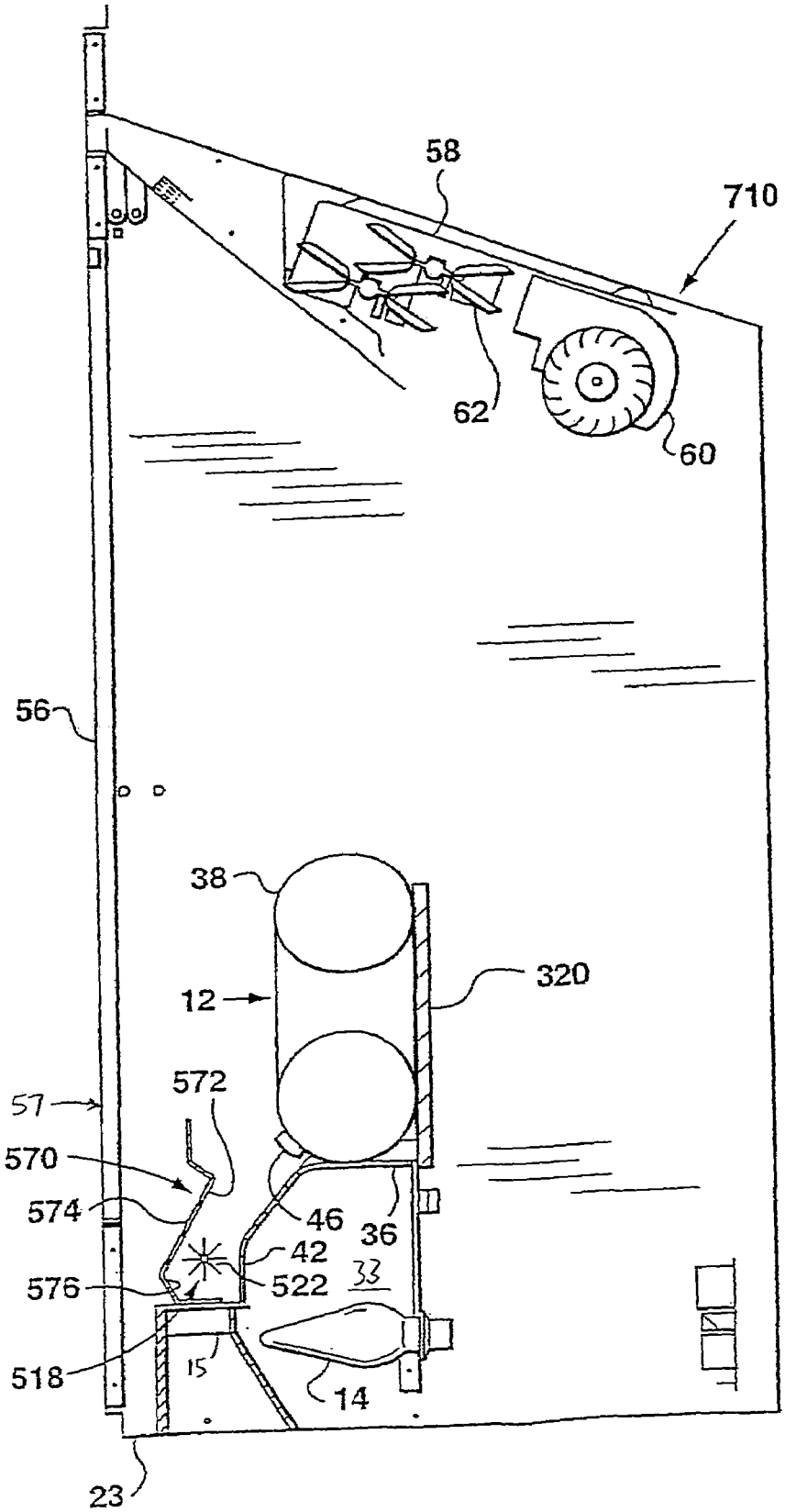
FIG. 16 is a sectional side view, similar to FIG. 3, of another embodiment of the flame simulating assembly according to the invention.

In another embodiment of a flame simulating assembly 710 shown in FIG. 16, the flame simulating assembly 710 does not include an element corresponding to the flicker element 48 or the screen 16, for example, as shown in FIG. 13. The translucent portion 42 is positioned in a path of light from the light source 14 to the dynamic reflector 518, and light is reflected onto the simulated fuel bed 12 by the reflective surfaces 522 and the reflective surface 576.

It will be evident to those skilled in the art that the invention can take many forms and that such forms are within the scope of the invention as claimed. Therefore, the spirit and scope of the appended claims should not be limited to the descriptions of the preferred versions contained herein.

I claim:

1. A flame simulating assembly for providing an image of flames, the flame simulating assembly having:

a simulated fuel bed;

a light source;

a screen with a front surface disposed behind the simulated fuel bed for transmitting light from the light source through the front surface such that the image of flames is transmitted through the front surface; and a dynamic reflector disposed in front of the simulated fuel bed and including a plurality of reflective surfaces and an axis about which the reflective surfaces rotate, the dynamic reflector being positioned in a path of light from the light source to the simulated fuel bed, for reflecting light from the light source to the simulated fuel bed.

2. A flame simulating assembly according to claim 1 additionally including a simulated grate disposed in front of the dynamic reflector, the simulated grate having an inner side disposed opposite an outer side thereof, the inner side being positioned adjacent to the dynamic reflector, the inner side of the simulated grate having a static reflective surface for reflecting light from the light source onto the simulated fuel bed.

3. A flame simulating assembly according to claim 1 additionally including a flicker element positioned in a path of light from the light source to the screen, to produce an image of flickering flames transmittable through the front surface of the screen.

4. A flame simulating assembly according to claim 3 additionally including a flame effect element positioned between the flicker element and the screen and in a path of flickering light from the light source, for configuring the flickering light to produce the image of flames transmittable though the front surface of the screen.

5. A flame simulating assembly according to claim 3 in which the light source is positioned below the simulated fuel bed and the flicker element is positioned behind the light source.

6. A flame simulating assembly according to claim 1 in which the simulated fuel bed includes a simulated ember bed and at least one simulated fuel element disposed above the simulated ember bed, and in which the simulated ember bed includes a translucent portion positioned in the path of light between the light source and the dynamic reflector, such that light from the light source is transmittable though the translucent portion.

7. A flame simulating assembly according to claim 1 in which the simulated fuel bed includes a simulated ember bed and at least one simulated fuel element disposed above the simulated ember bed, the simulated ember bed including a plurality of apertures positioned in the path of light from the light source to the dynamic reflector, such that light from the light source is transmittable through the apertures.

8. A flame simulating assembly having:

a simulated fuel bed including a simulated ember bed and at least one simulated fuel element positioned over the simulated ember bed;

a bottom wall element, the simulated ember bed being positioned at least partially above the bottom wall element and seated directly on the bottom wall element;

the simulated ember bed and the bottom wall element at least partially defining a compartment;

a light source;

the simulated ember bed including a front portion positioned in a path of light from the light source and adapted to permit light to be transmitted therethrough;

a front wall positioned in front of the simulated fuel bed, the front wall including an observation zone;

a dynamic reflector positioned above the bottom wall element and positioned outside the compartment and between the simulated ember bed and the front wall;

the dynamic reflector being positioned in the path of light from the light source for reflecting light from the light source onto the simulated fuel bed; and the dynamic reflector including an axis and a plurality of reflective surfaces which rotate about the axis, for causing light from the light source to flicker and to be reflected onto the simulated fuel bed.

9. A flame simulating assembly according to claim 8 in which said at least one simulated fuel element has at least one downwardly directed portion, the dynamic reflector being positioned relative to said at least one downwardly directed portion for reflecting light from the light source onto said at least one downwardly directed portion.

10. A flame simulating assembly according to claim 9 in which said at least one simulated fuel element additionally includes at least one partially reflective part positioned on said at least one downwardly directed portion in a path of light from the light source reflected from the dynamic reflector, for reflecting light to simulate burning embers.

11. A flame simulating assembly according to claim 10 in which said at least partially reflective part includes at least one ember decal, said at least one ember decal being positioned on said at least one downwardly directed portion in a path of light from the light source reflected from the dynamic reflector, for reflecting light to simulate burning embers.

12. A flame simulating assembly according to claim 11 wherein said at least one ember decal is reddish in color, such that said at least one ember decal simulates burning embers disposed on said at least one downwardly directed portion.

13. A flame simulating assembly according to claim 10 in which said at least one partially reflective part is reddish in color, such that said at least one partially reflective part simulates burning embers disposed on said at least one downwardly directed portion of said at least one simulated fuel element.

14. A flame simulating assembly according to claim 8 in which the front portion of the simulated ember bed is at least partially translucent.

15. A flame simulating assembly according to claim 8 additionally including a simulated grate positioned between the dynamic reflector and the front wall, the simulated grate having an inner side disposed adjacent to the dynamic reflector and an outer side positioned opposite to the inner side, the inner side having a static reflective surface thereon positioned in the path of light from the light source, for reflecting light from the light source onto the simulated fuel bed.

16. A flame simulating assembly according to claim 8 in which the front portion of the simulated ember bed includes a plurality of apertures through which light from the light source is transmittable to the dynamic reflector.

17. A flame simulating assembly according to claim 8 additionally including a screen with a front surface disposed behind the simulated fuel bed for transmitting light from the light source through the front surface such that an image of flames is transmitted through the front surface.

18. A flame simulating assembly according to claim 17 in which the screen includes a diffusing back member disposed behind the front surface for diffusing and transmitting light from the light source, and the flame simulating assembly additionally includes a flicker element positioned in a path of light between the light source and the diffusing back member, for creating a fluctuating light.

19. A flame simulating assembly according to claim 18 additionally including a flame effect element positioned in a path of the fluctuating light to configure the fluctuating light to form the image of flames which is transmittable through the front surface of the screen.

* * * * *